US005800243A

United States Patent [19]

Berman

[11] Patent Number: 5,800,243

[45] Date of Patent: Sep. 1, 1998

[54] TOY FIGURE WITH CLICKING SOUND EFFECT

[75] Inventor: Stephen G. Berman, Malibu, Calif.

[73] Assignee: Jakks Pacific, Inc., Malibu, Calif.

[21] Appl. No.: 740,709

[22] Filed: Nov. 1, 1996

[51] Int. Cl.[6] ..... A63H 5/00; A63H 3/46; A63H 3/28

[52] U.S. Cl. ..... 446/420; 446/378; 446/297

[58] Field of Search ..... 446/373, 376, 446/378, 379, 380, 382, 420, 297; 40/418–420

[56] References Cited

U.S. PATENT DOCUMENTS

| | | | |
|---|---|---|---|
| 718,662 | 1/1903 | Shaffer | 446/378 |
| 3,277,601 | 10/1966 | Ryan | 446/378 |
| 3,994,092 | 11/1976 | Sapkus et al. | 446/378 |
| 4,470,784 | 9/1984 | Piotrovsky | 425/116 |
| 4,623,317 | 11/1986 | Nagano | 446/289 |
| 4,673,373 | 6/1987 | Herring et al. | 446/378 |
| 4,750,895 | 6/1988 | Shinohara et al. | 446/230 |
| 4,952,189 | 8/1990 | Barlow | 446/241 |

FOREIGN PATENT DOCUMENTS

| | | |
|---|---|---|
| 1 373 205 | 11/1974 | United Kingdom . |
| 2151 495 | 7/1985 | United Kingdom . |
| 2 091 570 | 8/1989 | United Kingdom . |

*Primary Examiner*—Robert A. Hafer
*Assistant Examiner*—Laura Fossum
*Attorney, Agent, or Firm*—Lyon & Lyon LLP

[57] ABSTRACT

A toy figure having an arm or leg which is moulded from deformable plastic material and incorporates an internal clicking sound generating mechanism. The sound generating mechanism has a closed chamber and includes first and second members which are relatively movably engageable with each other inside the chamber for producing a clicking sound within the chamber upon relative movement where the arm or leg is bent. The arm or leg is formed by an insert moulding operation with the plastic material moulded to shape completely around the sound generating mechanism.

31 Claims, 5 Drawing Sheets

TOY FIGURE WITH CLICKING SOUND EFFECT

The present invention relates to a toy figure which incorporates a clicking sound generator.

BACKGROUND OF THE INVENTION

Clicking sound generators for toys are generally known. For example, as disclosed in UK Patent Application No. 8431602 published under Publication No. 2151495, one form of a clicking sound generator is provided by a resilient finger-like member and a cog wheel which is, upon rotation, momentarily engageable with the finger-like member to produce a clicking sound. Certain other clicking sound generators are disclosed in UK Patent No. 1373205 and UK Patent Application No. 8138187 published under Publication No. 2091570.

SUMMARY OF THE INVENTION

In accordance with one aspect of the present invention, there is provided a toy figure having a body part which is moulded of deformable plastic material, said body part having incorporated therein a sound generating mechanism which comprises first and second members relatively movably engageable with each other for producing a clicking or tapping sound upon relative movement thereof, at least the respective portions of said members which are engageable with each other for producing said sound being arranged inside a closed chamber which is substantially impermeable or impervious to the plastic material during moulding.

In one embodiment of the invention, the body part is formed by an insert moulding operation with the plastic material moulded to shape completely around at least the closed chamber.

Conveniently, the members may form the skeleton of the body part and the relative movement of the members may deform and determine the shape or configuration of the body part. In practice, the body part would be bent.

In accordance with another aspect of the present invention, there is provided a toy figure having a part which is moulded from deformable plastic material, said part incorporating an internal clicking sound generator which has a closed chamber and includes first and second members relatively movably engageable with each other inside said chamber for producing a clicking sound upon relative movement when said part of the toy figure is bent, said part being formed by an insert moulding operation with the plastic material moulded to shape completely around said generator.

Preferably, the chamber is provided by the first member which has a portion inside the chamber for engaging a portion of the second member.

More preferably, the chamber has an opening at which the portion of the second member is positioned closing said opening of the chamber as a sliding fit.

In a preferred embodiment, the members have respective portions and the chamber has an opening to which the portion of the second member is pivotably connected for movably engaging the portion of the first member inside the chamber to produce a clicking sound.

Further more preferably, the portions of the first and second members have a pointed end and a series of teeth, respectively.

Conveniently, the chamber may be formed by two separate parts which are sealed together.

It is preferred that the members are elongate and have adjacent ends connected together for relative pivotal movement.

Preferably, the toy figure has a shape resembling a human being. More preferably, the part is in the form of a limb.

In practice, the toy figure would have a dimension between 5 and 6 inches. In most cases, the toy figure would be less than 12 inches.

BRIEF DESCRIPTION OF THE DRAWINGS

The invention will now be more particularly described, by way of example only, with reference to the accompanying drawings, in which.

DETAILED DESCRIPTION OF PREFERRED EMBODIMENT

Figure 1:
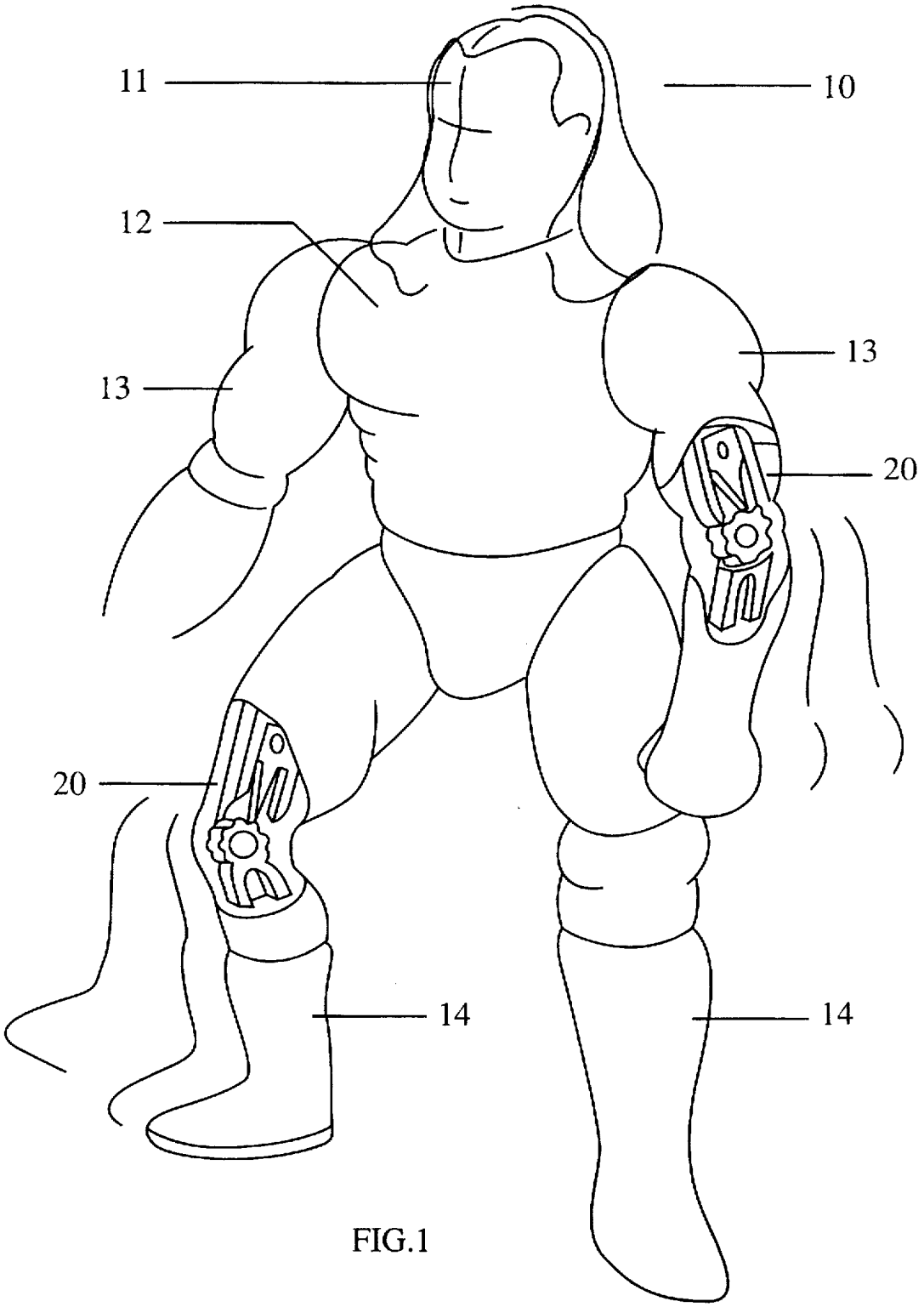
FIG. 1 is a front perspective view of an embodiment of a toy figure in accordance with the present invention, having an arm and a leg partially broken to show respective internal sound generators.
Figure 2A:
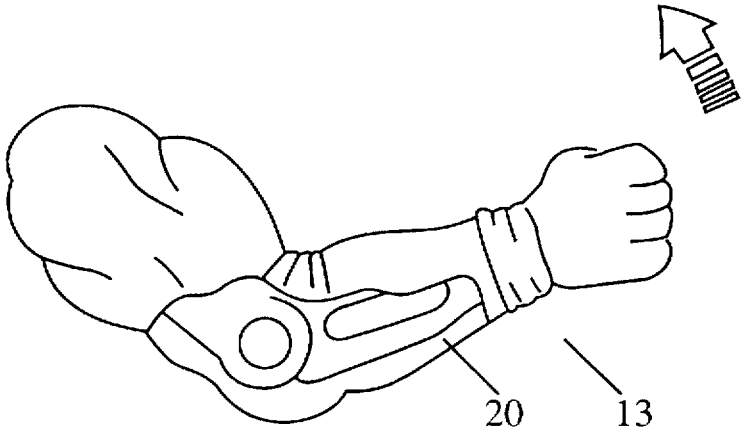
FIG. 2A is a side view of the arm of FIG. 1.
Figure 2B:
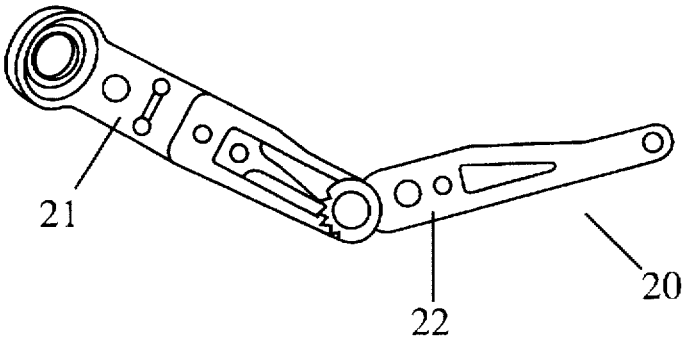
FIG. 2B shows the sound generator for the arm.
Figure 3A:
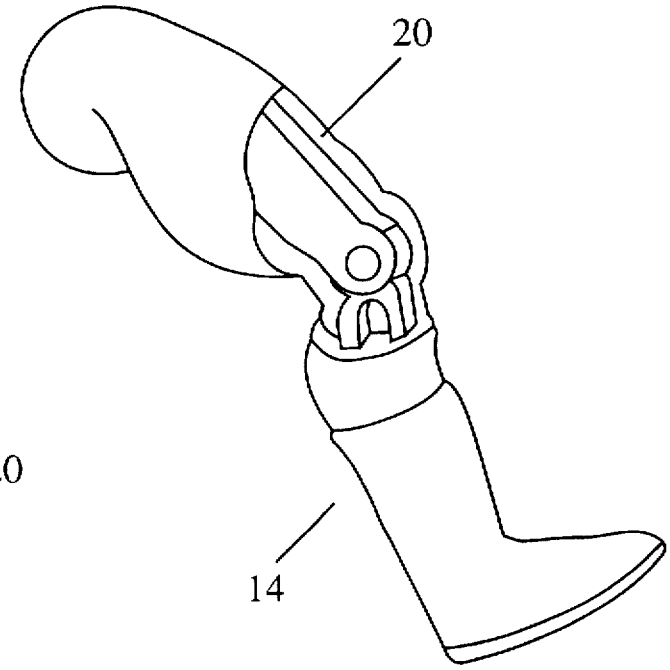
FIG. 3A is a side view of the leg of FIG. 1.
Figure 3B:
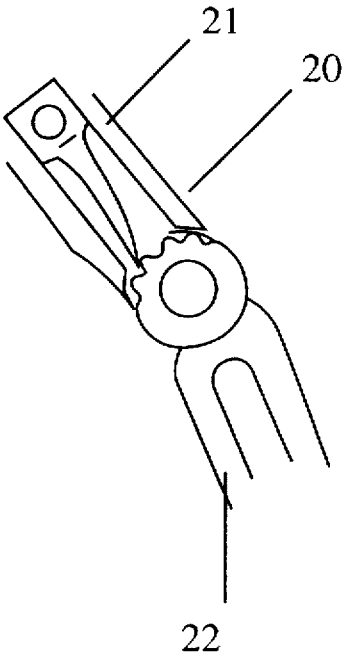
FIG. 3B shows the sound generator of the leg.
Figure 4A:
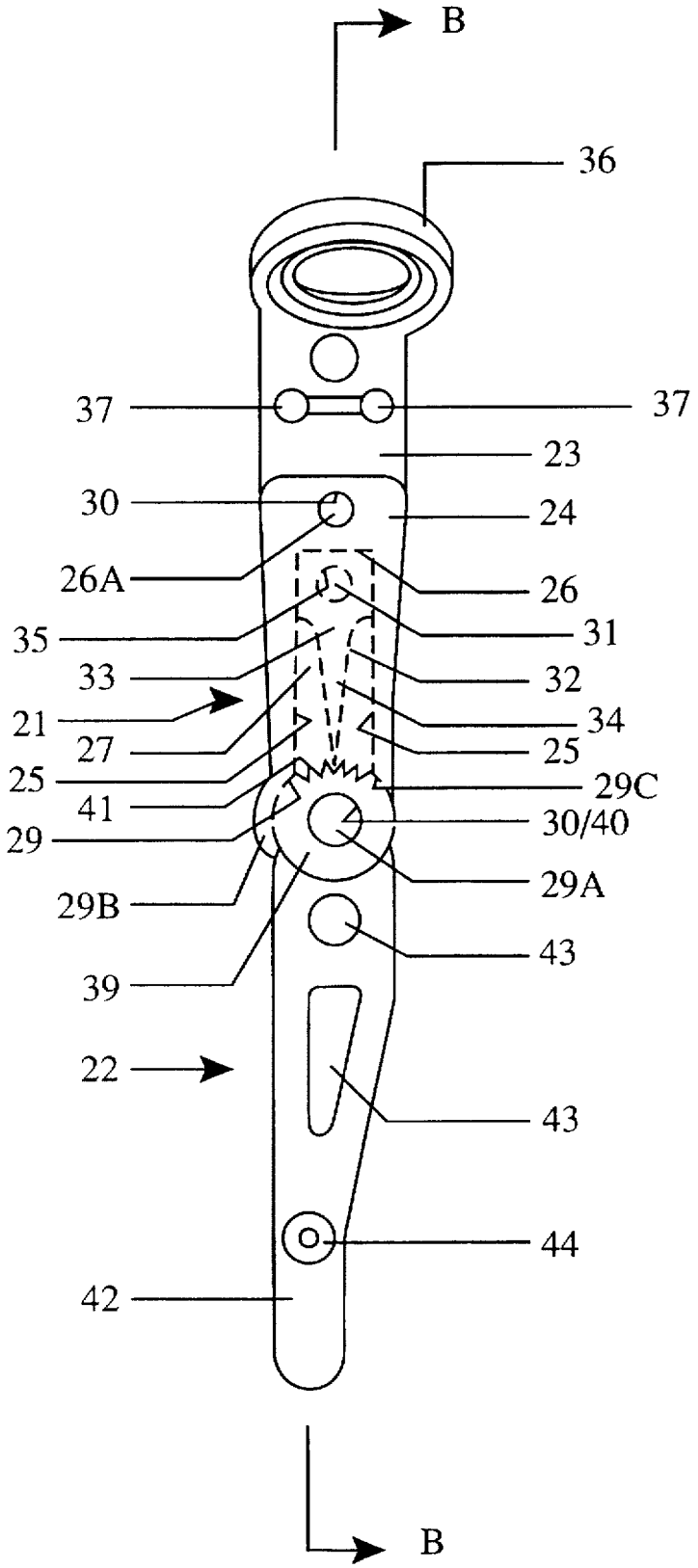
FIG. 4A is a side view of the sound generator of FIG. 2B or of FIG. 3B.
Figure 4B:
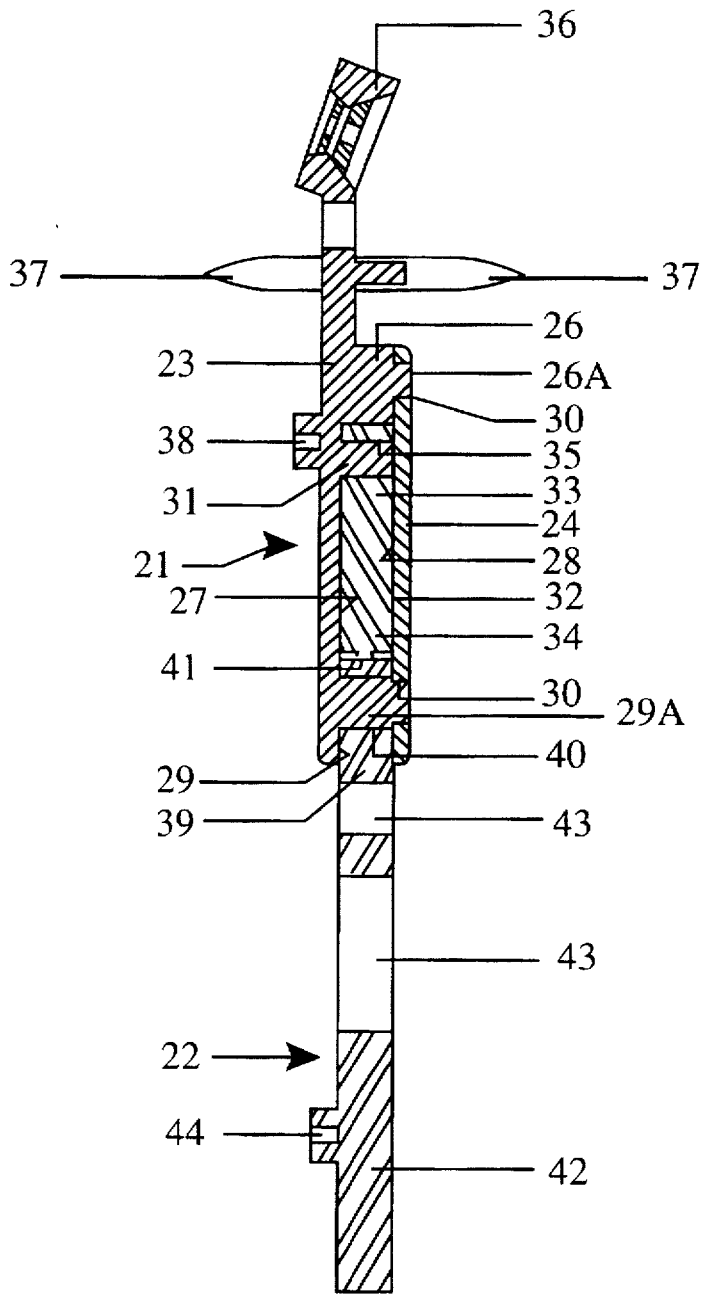
FIG. 4B is a cross-sectional view of FIG. 4A taken along line B—B of FIG. 4A.

Referring to the drawings, there is shown a toy figure, for example in the shape of a human wrestler 10 between 5 and 6 inches in dimension, embodying the invention, which wrestler 10 has a head 11 and a body 12, and two arms 13 and two legs 14 which are moulded from PVC plastic material to be slightly flexible or deformable in a resiliently manner. Each arm 13 or leg 14 incorporates an internal sound generator 20 which is adapted to produce a clicking sound when the arm 13 or leg 14 is bent at the elbow or knee position.

The sound generator 20 is formed by first and second bars 21 and 22 which are hinged end-to-end together for limited pivotal movement relative to each other to produce the clicking sound.

The first bar 21 is formed by elongate base 23 and lid 24. The base 23 has an integral series of two side walls 25 and an end wall 26 together defining a chamber 27. The chamber 27 is flat and oblong and has an open principal side 28 and an open end 29 opposite to the end wall 26. The end wall 26 and the open end 29 are provided with respective upstanding central posts 26A and 29A. The lid 24, which has opposite end holes 30, closes the open side 28 of the chamber 27 and is located in position by means of its end holes 30 engaging the respective posts 26A and 29A. Ultrasonic welding, heat sealing or glue may be used to secure the lid 24 against the walls 25 and 26, whereby the chamber 27 is fully closed or sealed except at the open end 29 on opposite sides of the post 29A.

Inside the chamber 27, an integral central post 31 is formed on the base 23 close to the end wall 26 and a resilient thin wedge-like blade 32 is held captive. The blade 32 has a broad rear end 33 and a pointed front end 34, said rear end 33 bearing a central hole 35. The rear end 33 has a shape almost the same as that of the end of the chamber 27 closed by the end wall 26 and is fitted in position with the hole 35 engaging the post 31. The front end 34 points, at a small distance off, at the post 29A at the open end 29 of the chamber 27. The base 23 includes, at an end opposite to the chamber open end 29, an inclined integral ring 36, and further includes integral spikes 37 on opposite sides between the chamber 27 and the ring 36 and an integral collar 38 under the chamber 27.

The second bar 22 has a rounded first end 39 which is provided with a central hole 40 to form half a ring. The round end 39 is serrated, on its outermost side, to form a series of triangular teeth 41. Opposite end 42 of the second bar 22 is thinner than the round end 39. The body of the second bar 22 is formed with two openings 43 and an integral collar 44.

To assemble the two bars 21 and 22 together, while they are extending co-parallel, the round end 39 of the second bar 22 is disposed around the post 29A of the first bar 21. The open end 29 of the chamber 27 is thus closed by the round end 39. The lid 24 is then positioned to close and seal the open side 28 of the chamber 27, as described above. In this assembled condition, the blade end 34 of the first bar 21 and the end teeth 41 of the second bar 22 come into inter-engagement inside the chamber 27. Also, the second bar 22 is pivotable, to a limited extent, typical between 180° and 45° about the post 29A relative to the first bar 21.

The open end 29 of the chamber 27 has partially circular opposite sides 29B and 29C to form an angular sliding fit with the respective partially circular sides of the round end 39 on opposite sides of the teeth 41. Such a sliding fit ensures that the chamber 27 is also closed at its open end 29, whereby the chamber 27 is fully closed. One side 29B of the open end 29 is extended to restrict the pivotal movement of the second bar 22 only to the opposite side.

Upon back and forth pivotal movement of the second bar 22 relative to the first bar 21, the teeth 41 of the round end 39 of the second bar 22 will in turn momentarily engage with and disengage from the pointed end 34 of the blade 32 of the first bar 21, thereby producing a clicking sound. Conversely, the first bar 21 may be pivoted back and forth relative to the second bar 22, with the blade end 34 of the first bar 21 clicking through the end teeth 41 of the second bar 22 to produce the same sound.

Each arm 13 or leg 14 is formed by an insert moulding operation, in which the assembled sound generator 20 is initially placed inside an appropriate mould and molten PVC plastic material is then injected into the mould to surround and enclose the sound generator 20 completely. As the chamber 27 is fully closed or sealed and made impermeable or impervious to the plastic material, the moulding material cannot leak into the chamber 27 to clog or otherwise interfere with the workings of the blade 32 and the second bar end 39 including the teeth 41. The sound generator 20 is arranged to extend across the elbow or knee, with the first bar 21 along the upper arm or thigh and the second bar 22 along the forearm or lower leg, such that when the limb 13 or 14 is bent about the elbow or knee, the sound generator 20 will produce a clicking sound.

The ring 36 of the first bar 21 is exposed at the root end of the arm 13 or leg 14 and provides a rigid opening for hinging the limb 13 or 14 to the body 12 of the wrestler 10. The spikes 37, collars 38 and 44 and openings 43 on the bars 21 and 22 serve as additional formations for anchoring with the set or cured plastic material, thereby avoiding displacement of the sound generator 20.

The insert moulding operation is commonly used to manufacture toy figures having a dimension less than 12 inches. The moulded plastic material used is deformable and has the suitable thickness and flexibility or hardness to allow the arm 13 or leg 14 to be bent into different positions and be able to hold those positions.

It is envisaged that the sound generator 20 may be provided across the neck or waist of the wrestler 10, for producing a similar clicking sound when the neck or waist is bent.

The invention has been given by way of example only, and various other modifications of and/or alterations to the described embodiment may be made by persons skilled in the art without departing from the scope of the invention as specified in the appended claims.

What is claimed is:

1. A toy figure comprising:

a sound generating mechanism comprising first and second members;

a body part moulded around said sound generating mechanism from a deformable plastic material; and wherein said first and second members have portions which are relatively movably engaged with each other, and which are arranged inside a closed chamber which is substantially impermeable or impervious to said plastic material during moulding, and which are configured to produce a clicking or tapping sound upon relative movement thereof.

2. A toy figure as claimed in claim 1, wherein the body part is formed by an insert moulding operation with the plastic material moulded to shape completely around at least the closed chamber.

3. A toy figure as claimed in claim 2, wherein the members form a skeleton of the body part and the relative movement of the members deforms and determines the shape or configuration of the body part.

4. A toy figure as claimed in claim 3, wherein the body part is bendable.

5. A toy figure as claimed in claim 1, wherein the members have respective portions and the chamber has an opening to which the portion of the second member is pivotably connected for movably engaging the portion of the first member inside the chamber to produce the clicking sound.

6. A toy figure as claimed in claim 5, wherein the portions of the first and second members have a pointed end and a series of teeth, respectively.

7. A toy figure as claimed in claim 1, wherein the chamber is formed by two separate parts which are sealed together.

8. A toy figure as claimed in claim 1, wherein the members are elongate and have adjacent ends connected together for relative pivotal movement.

9. A toy figure as claimed in claim 5, wherein the members are elongate and have adjacent ends connected together for relative pivotal movement.

10. A toy figure as claimed in claim 9, having a shape resembling a human being.

11. A toy figure as claimed in claim 10, wherein the part is in the form of a limb.

12. A toy figure as claimed in claim 11, having a dimension less than 12 inches.

13. A toy figure as claimed in claim 12, having a dimension between 5 and 6 inches.

14. A toy figure as claimed in claim 1, having a shape resembling a human being.

15. A toy figure comprising:

a deformable plastic part and an internal clicking sound generating mechanism incorporated therein;

said deformable plastic part formed by an insert moulding operation of a deformable plastic material to shape completely around said internal clicking sound generating mechanism;

said internal clicking sound generating mechanism having a closed chamber and first and second members; and wherein said first and second members are relatively movably engaged with each other inside said closed chamber for producing a clicking sound within said closed chamber upon relative movement when said deformable plastic part of the toy figure is bent.

16. A toy figure as claimed in claim 15, wherein the chamber is provided by the first member which has a portion inside the chamber for engaging a portion of the second member.

17. A toy figure as claimed in claim 16, wherein the chamber has an opening and the portion of the second member is positioned at said opening of the chamber.

18. A toy figure as claimed in claim 17, wherein the portions of the first and second members have a pointed end and a series of teeth, respectively.

19. A toy figure as claimed in claim 15, wherein the members have respective portions and the chamber has an opening to which the portion of the second member is pivotably connected for movably engaging the portion of the first member inside the chamber to produce a clicking sound.

20. A toy figure as claimed in claim 19, wherein the portions of the first and second members have a pointed end and a series of teeth, respectively.

21. A toy figure as claimed in claim 15, wherein the chamber is formed by two separate parts which are sealed together.

22. A toy figure as claimed in claim 15, wherein the members are elongate and have adjacent ends connected together for relative pivotal movement.

23. A toy figure as claimed in claim 15, having a shape resembling a human being.

24. A toy figure as claimed in claim 23, wherein the part is in the form of a limb.

25. A toy figure as claimed in claim 23, having a dimension less than 12 inches.

26. A toy figure as claimed in claim 23, having a dimension between 5 and 6 inches.

27. A toy figure as claimed in claim 19, wherein the members are elongate and have adjacent ends connected together for relative pivotal movement.

28. A toy figure as claimed in claim 27, having a shape resembling a human being.

29. A toy figure as claimed in claim 28, wherein the part is in the form of a limb.

30. A toy figure as claimed in claim 29, having a dimension less than 12 inches.

31. A toy figure as claimed in claim 30, having a dimension between 5 and 6 inches.

* * * * *